US005393239A

United States Patent [19]

Ursich

[11] Patent Number: 5,393,239

[45] Date of Patent: Feb. 28, 1995

[54] SELF-LOCKING FEMALE ELECTRICAL SOCKET HAVING AUTOMATIC RELEASE MECHANISM

[75] Inventor: Nels E. Ursich, 6809 W. Brementowne Dr., Apt. 2W, Tinley Park, Ill. 60477

[73] Assignee: Nels E. Ursich, Tinley Park, Ill.

[21] Appl. No.: 172,746

[22] Filed: Dec. 27, 1993

[51] Int. Cl.[6] ..... H01R 13/62

[52] U.S. Cl. ..... 439/180; 439/346

[58] Field of Search ..... 439/134, 140, 180, 345, 439/346, 347, 348, 369, 373

[56] References Cited

U.S. PATENT DOCUMENTS

| | | | |
|---|---|---|---|
| 1,404,098 | 1/1922 | Dennis | 439/270 |
| 2,198,504 | 4/1940 | Pool | 439/346 |
| 2,631,185 | 3/1953 | Earle et al. | 439/191 |
| 2,664,734 | 1/1954 | McEneaney | 439/134 |
| 2,732,531 | 1/1056 | Janowiec | 439/346 |
| 3,121,599 | 2/1964 | Modrey | 439/346 |
| 3,200,365 | 8/1965 | Carpinone | 439/346 X |
| 4,179,175 | 12/1979 | Farnworth et al. | 439/348 |
| 4,566,297 | 1/1986 | Hawley | 439/348 |
| 4,909,749 | 3/1990 | Long | 439/346 X |
| 5,281,162 | 1/1994 | Ursich | 439/346 |

FOREIGN PATENT DOCUMENTS 0122842 10/1984 European Pat. Off. .

*Primary Examiner*—Khiem Nguyen

*Attorney, Agent, or Firm*—Edward D. Gilhooly

[57] ABSTRACT

A self-locking female electrical socket having an automatic release mechanism. The female socket includes releasable balls that urged into locking engagement with the prongs of a male plug. The plug may be released for reasons of maintaining cord in tact through deflection of a deflectable element positioned adjacent the prong.

11 Claims, 3 Drawing Sheets

SELF-LOCKING FEMALE ELECTRICAL SOCKET HAVING AUTOMATIC RELEASE MECHANISM

BACKGROUND OF THE INVENTION

1. Field of the Invention

This invention relates to electrical cords and, more specifically, to a release mechanism for a locking electrical receptacle.

2. Summary of the Prior Art

In certain situations, it is highly advantageous to lock the male prongs of an electrical cord to a female socket to maintain an electrical connection. Examples of highly effective self-locking sockets are shown in my prior U.S. Pat. No. 5,129,836 issued Jul. 14, 1992 and entitled SELF-LOCKING FEMALE RECEPTOR FOR ELECTRICAL CORD. The socket of the foregoing '836 patent provides a self-locking capability by which a male plug is effectively locked and retained in the electrical receptacle and is prevented from undesired separation and disconnection. Because the locking capability of the foregoing female sockets is so effective, it is possible that the electrical cords may separate or be torn away from the male plug or the female receptacles prior to release by the locking mechanism under extreme conditions. In such situations, potentially hazardous bare conductive wires may be exposed. Accordingly, it is desirable to provide a release capability to allow automatic separation of a locked male plug from its female receptacle at a level of force less than the magnitude causing failure of the connection between the male plug or electrical socket and its respective electrical cord.

SUMMARY OF THE INVENTION

It is therefore an objective of the present invention to provide a release mechanism for a self-locking female socket. The female sockets of the invention herein insure release and separation of the male plug and female socket before the electric cords connected to these element are pulled away and fail. The embodiments of the invention employ yieldable, resilient elements that allow release of the male prongs from the female socket at a predetermined pulling force to maintain the cords in tact. The electrical sockets disclosed herein are effective in locking the male plug, but provide a safety release in response to large pulling forces. The socket of the invention is economical to manufacture, easy to use in service, and is capable of long service.

DESCRIPTION OF THE PREFERRED EMBODIMENTS

Figure 1:
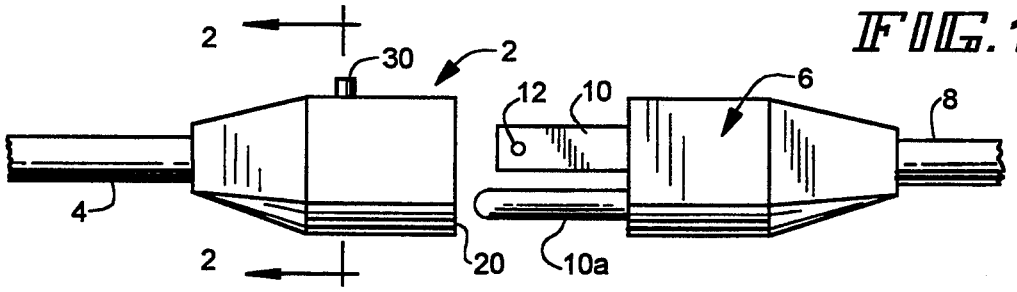
FIG. 1 is a side elevational view of a first embodiment of the self-locking female electrical socket having an automatic release mechanism of the invention.
Figure 2:
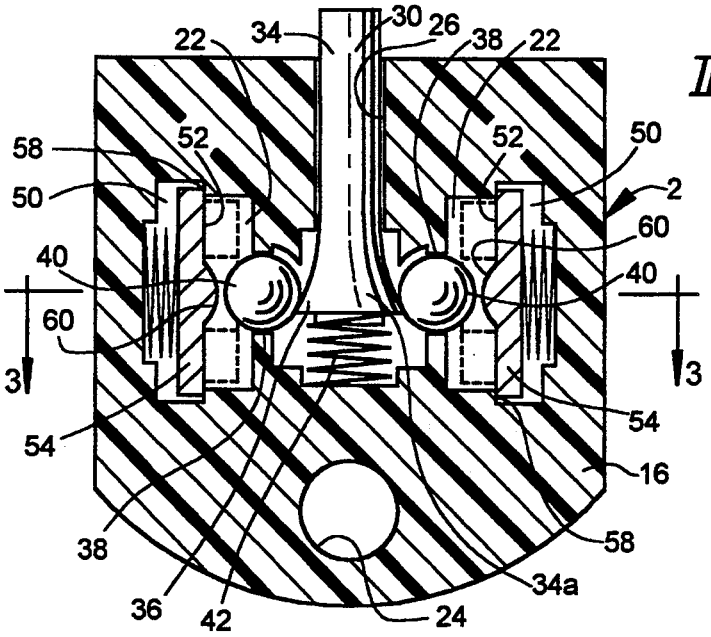
FIG. 2 is an end elevation view, with parts in section, of the female socket taken along lines 2—2 of FIG. 2.
Figure 3:
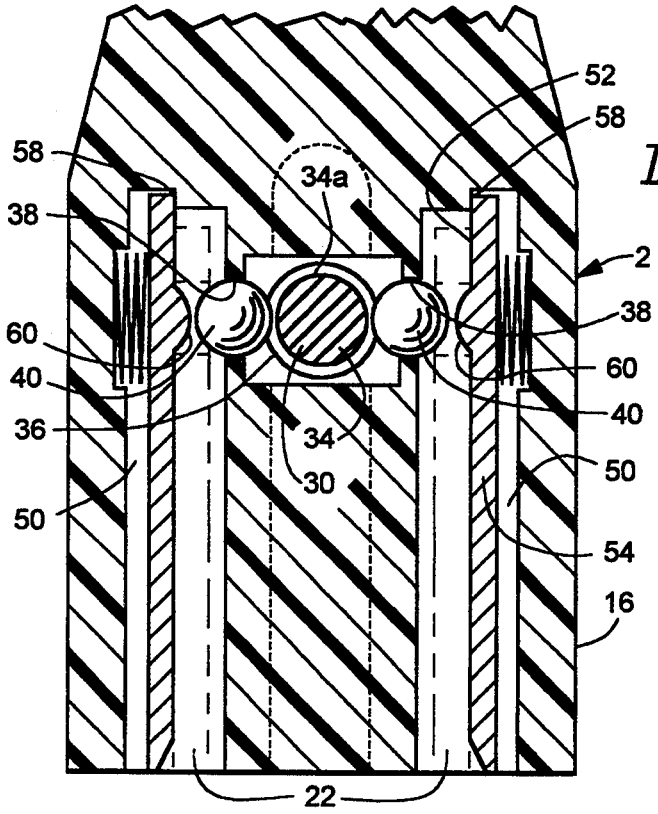
FIG. 3 is a partial top plan view, with parts in section, taken along lines 3—3 of FIG. 2.

Referring now to FIGS. 1–3, there is illustrated the first embodiment of the invention for a self-locking female socket having an automatic release mechanism and being generally designated by reference numeral 2. Electrical female socket 2 is connected to a typical electrical line or cord 4 having external electrical insulating material. The female socket 2 is intended to be interconnected with a male plug 6 which is attached to a second electrical line or cord 8. The male plug 6 and female socket 2 can be attached to any type of conductive electrical lines, such as in connection with extension cords and other numerous conductive components as are well known. The male plug 6 is conventionally provided with a pair of flat exterior prongs 10 formed from a metal conductive material and being electrically connected to cord 8. A conductive ground prong 10*a* of a generally cylindrically shape is also provided on the male plug 6. Each prong 10 includes a punched hole 12.

The female socket 2 includes a socket body 16 that is fabricated from a suitable electrically, non-conductive material, such as a molded plastic. The end face 20 of socket is provided with a pair of plug holes 22 extending into the socket body 16 and having a rectangular cross sectional configuration and a round ground hole 24 for respectively receiving male prongs 10 and ground prong 10*a*. The insertion of the prongs 10 and grounding prong 10*a* will provide an electrical connection between cords 4 and 8 through typical conductive contacts in socket body 16 (not shown).

The socket body 16 is formed with a passage 26 opening from the top that extends downward perpendicular to the prong openings 22. An elongated shaft 30 made from an electrically nonconductive material is movably positioned within the passage 26. The elongated shaft 30 has a cylindrical upper portion 34 and a lower portion 34*a* having a flared end 36. The top of upper portion 34 extends above socket body 16 to provide a manually depressible actuator situated at an accessible exterior position on body 16. A pair of openings 38 in socket body 16 have a configuration to capture a pair of balls 40 for limited movement outward from the openings 38 due to a reduction of width of the openings 38 adjacent the prong openings 22.

The balls 40 are permitted movement toward the narrowed down cylindrical portion 34 of the actuator shaft 30 when the cylindrical portion 34 is radially aligned with openings 38. Thus, as the prongs 10 are inserted in prong openings 22 with actuator 30 being depressed, the prongs 10 are free to move to a fully inserted position. In the undepressed position of actuator 30, the openings 38 and balls 40 are aligned with flared portion 36 to urge the balls 40 outward into engagement with a hole 12 of prong 10. The axial position of the balls 40 is further selected to correspond to the position of prong holes 12.

A spring 42 urges the actuator 30 outward so that the balls 40 automatically engage the prong holes 12 and lock the male plug 6 in the female socket 2. Release of the male plug 6 can simply be attained by depressing shaft 30 to align the narrowed down cylindrical portion 34 with the balls 40, such that the balls can easily be deflected inwardly as prongs are pulled out for removal.

A cavity 50 is formed in body 16 on each side substantially along the length of the socket prong openings 22. An access opening 52 exists between the prong openings 22 and the cavities 50 and is radially aligned with the prong holes 12 when fully inserted in socket body 6. A deflectable flat bar 54 is resiliently biased by spring 56 within cavity 50 against the access opening 52. The spring 56 may be a single coil spring as shown or a plurality of springs of either a metal or plastic material. As seen in FIG. 2, access opening 52 is formed in socket body 16 with an axial dimension less than the corresponding dimension of bar 54 so that areas 58 of socket body 16 act as stop areas. The width of the prongs 12, however, is less than access opening 52. A semi-spherical projection or bulb 60 is formed on the bar 54 to also engage prong hole 12 as shown in FIGS. 2 and 3. The bulb 60 acts to cam the prongs 10 outward upon the application of a predetermined force between the socket 2 and male plug 6. The spring 56 resilient properties permits the prongs 10 to flex outward and deflect the deflectable bar 54 outward into cavity 50 upon application of a predetermined pulling force between socket 2 and plug 6. The outward deflection of the male prongs 10 causes a sufficient separation of contact of balls 40 with prong opening 22 to release the locking engagement and permit the male plug 6 and socket 2 to separate before either cords 4 or 8 can be pulled away and disconnected from either plug 6 or socket 2.

Figure 4:
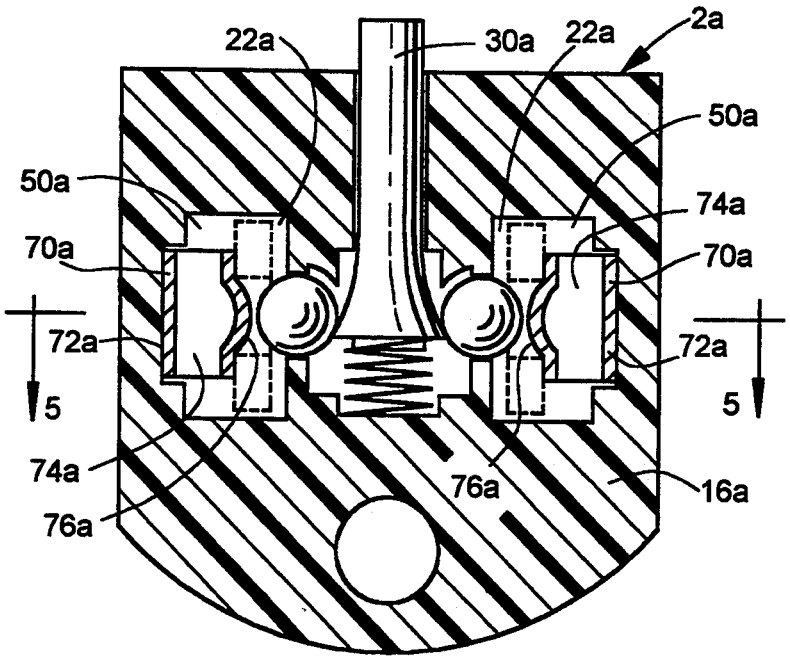
FIG. 4 is an end elevational view, with parts in section, of a second embodiment of the female socket having an automatic release mechanism of the invention.
Figure 5:
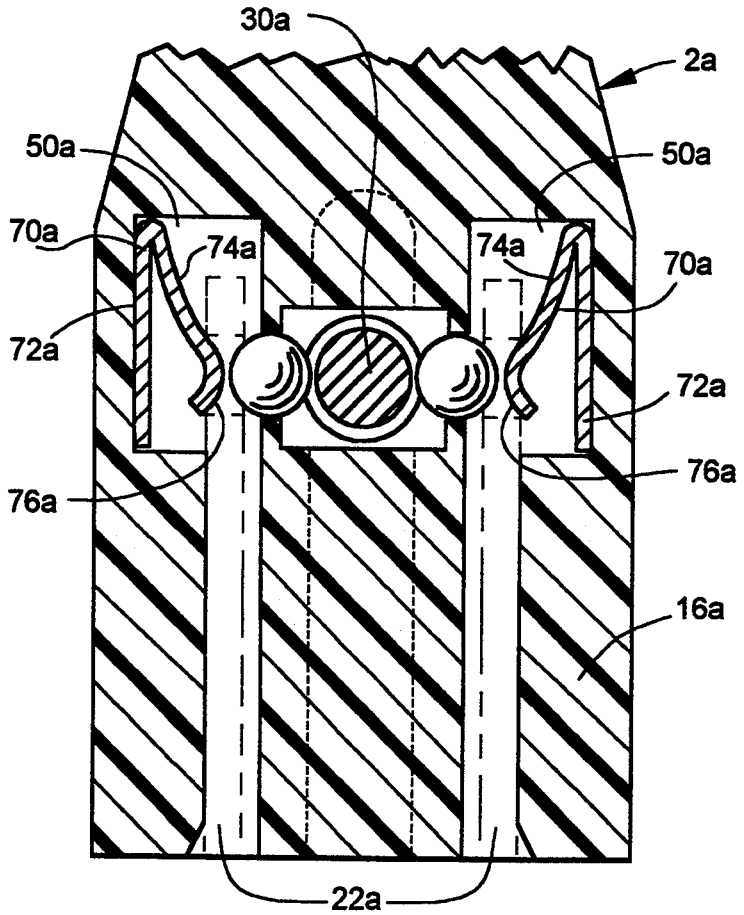
FIG. 5 is a partial top plan view, with parts in section, of the female socket taken along lines 5—5 of FIG. 4.

Referring to FIGS. 4 and 5, there is illustrated a second embodiment of the invention for a self-locking female socket having an automatic release mechanism and generally designated by reference numeral **2*a*. The embodiment of FIGS. 4 and 5 is identical to that described with reference to FIGS. 1 to 3 except that the cavity 50*a* and release mechanism is modified. The socket 2*a* includes a socket body 16*a* having female prong openings 22*a*. The prongs of a male plug are locked by balls 40*a* in cooperation with actuator shaft 30*a* in the same manner as described with reference to FIGS. 1–3**.

The automatic release mechanism of FIG. 4 and 5 includes a pair of cavities **50*a* opening adjacent the outer face of the male prong 10. A leaf spring 70*a* having a flat base 72*a* and an angular projecting resilient portion 74*a* that extends into cavity 50 in contact with the end portion of prong 10. The angular portion includes a curved section 76*a* that engages prong hole 12. As in the preceding embodiment leaf spring 70*a* is selected to have a resilient force a magnitude to allow the prongs 12 to deflect upon the application of a predetermined force between the plug and socket. Through deflection, the male plug 10 may be released and separate from the locking action of the ball 40*a*** prior to the respective electrical cords (not shown) being torn away from the socket or male plug.

Figure 6:
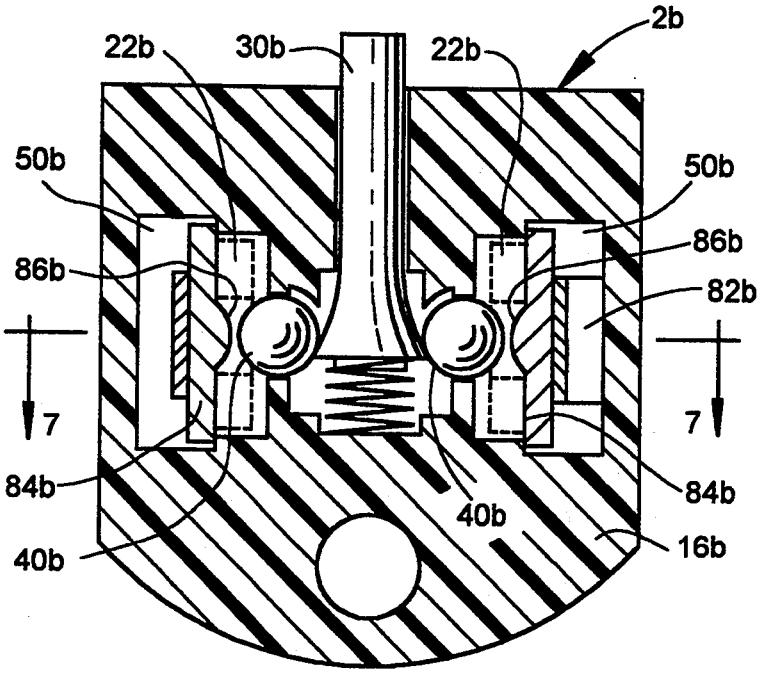
FIG. 6 is an end elevational view, with parts in section, of a third embodiment of the female socket having an automatic release mechanism of the invention.
Figure 7:
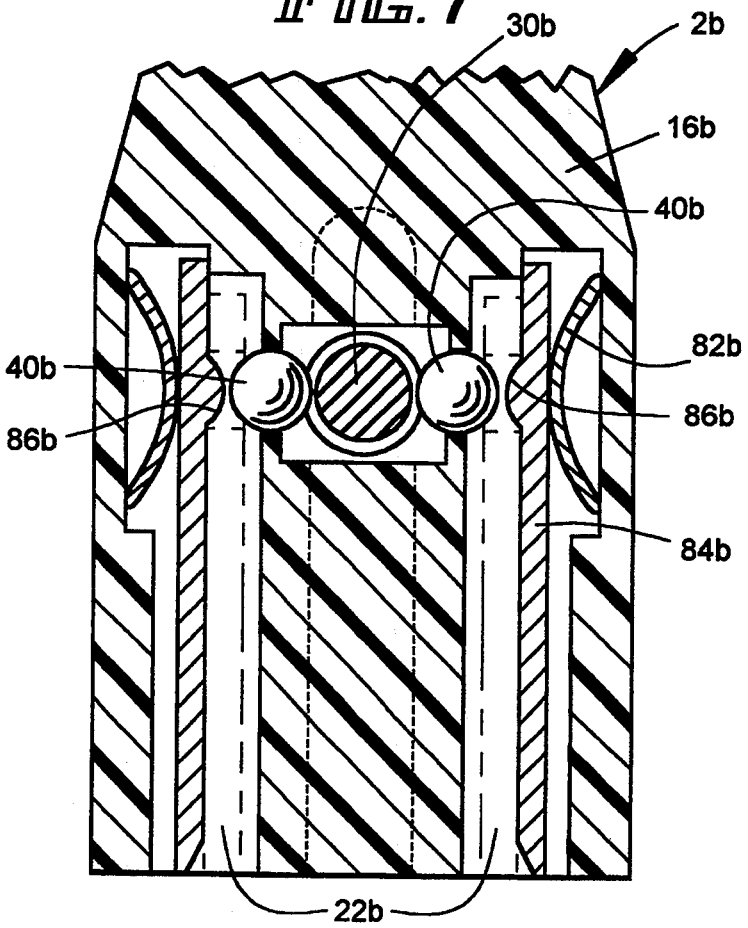
FIG. 7 is a partial top view, with parts in section, of the female socket taken along lines 7—7 of FIG. 6.

Referring to FIGS. 6 and 7, there is illustrated a second embodiment of the invention for a self-locking female socket having an automatic release mechanism and generally designated by reference numeral **2*b*. The embodiment of FIGS. 6 and 7 is identical to that described with reference to FIGS. 4 and 5 except that the cavity 50*b* and release mechanism is modified. The socket 2*b* includes a socket body 16*b* having female prong openings 22*b*. The prongs of a male plug are locked by balls 40*b* in cooperation with actuator shaft 30*b* in the same manner as described with reference to FIGS. 1–3**.

The automatic release mechanism of FIG. 6 and 7 includes a pair of cavities **50*b* opening adjacent the outer face of the male prong 10. A leaf spring 82*b* having a curved bowed configuration that extends into each cavity 50*b* in contact with elongated bars 84*b*. The bar 84*b* includes a bulb or bead 86*b* that engages prong holes 12. As in the preceding embodiment leaf spring 80*b* is selected to have a resilient force a magnitude to allow the prongs 12 to deflect upon the application of a predetermined force between the plug and socket. Through deflection, the male plug 10 may be released and separate from the locking action of the ball 40*b*** prior to the respective electrical cords (not shown) being torn away from the socket or male plug.

What is claimed is:

1. A locking female electrical socket having an automatic release mechanism comprising a female socket body having a pair of holes for receiving the spaced prongs having punched holes of a male plug for electrically connecting two electrical lines respectively coupled to said female socket body and the male plug, said female socket body having actuator means being mounted for selective relative movement between a first and second position within said female socket body, locking means mounted in said female socket in operative relationship to said actuator means to permit insertion and removal of the prongs at a first position of said actuator means in said female socket and said locking means being rigidly urged by said actuator means into locking engagement with the holes of the spaced prongs in a second position of said actuator means in said socket body, and release means in said female socket body for releasing the prongs of the male plug from said female socket in said second position of said actuator means upon application of a predetermined pulling force between the male plug and said female socket, said release means is mounted in said female socket body against to the prongs of the male plug, said release means having at least one deflectable element resiliently biased against a prong.

2. The socket according to claim 1 wherein said at least one deflectable element permits the prongs to be released from said locking means in said second position of said actuator means.

3. The socket according to claim 2 wherein said at least one deflectable element is a pair of deflectable elements respectively mounted in confronting relationship to the prongs of a male plug inserted in said pair of holes in said female socket body.

4. The socket according to claim 2 wherein said at least one deflectable element is mounted in a cavity in said female socket body, and further comprising resilient means being mounted in said cavity for urging said at least one deflectable element toward a prong and permit deflection of a prong upon application of said predetermined pulling force between the male plug and said female socket body.

5. The socket according to claim 4 wherein said socket body includes an access opening between said cavity and one of the holes of said socket body, said at least one deflectable element being urged by said resilient means toward said access opening.

6. The socket according to claim 4 wherein said at least one deflectable element contacts a portion of said socket body to prevent said at least one deflectable element from passing through said access opening into one of said holes of said socket body.

7. The socket according to claim 2 wherein said at least one deflectable element includes a raised portion engaging one of the punched holes of the prong, said raised portion aiding in deflecting said at least one deflectable element upon application of the predetermined pulling force between the male plug and said female socket.

8. The socket according to claim 4 wherein said resilient means is at least one coil spring.

9. The socket according to claim 4 wherein said resilient means is at least one leaf spring.

10. A locking female electrical socket having an automatic release mechanism comprising a female socket body having a pair of holes for receiving the spaced prongs having punched holes of a male plug for electrically connecting two electrical lines respectively coupled to said female socket body and the male plug, said female socket body having actuator means being mounted for selective relative movement between a first and second position within said female socket body, locking means mounted in said female socket in operative relationship to said actuator means to permit insertion and removal of the prongs at a first position of said actuator means in said female socket and said locking means being urged by said actuator means into locking engagement with the holes of the spaced prongs in a second position of said actuator means in said socket body, release means in said female socket body for releasing the prongs of the male plug from said female socket in said second position of said actuator means upon application of a predetermined pulling force between the male plug and said female socket, said release means is mounted in said female socket body adjacent to the prongs of the male plug, said release means includes at least one deflectable element permitting the prongs to be released from said locking means in said second position of said actuator means, and said at least one deflectable element is a leaf spring mounted in said cavity.

11. The socket according to claim 10 wherein said leaf spring includes a raised portion urged into one of the punched holes of the inserted prong.

* * * * *